US006499776B2

(12) United States Patent
Takamura

(10) Patent No.: US 6,499,776 B2
(45) Date of Patent: Dec. 31, 2002

(54) AUTOMOTIVE LOCK OPENING AND CLOSING APPARATUS

(75) Inventor: Noboru Takamura, Kanagawa (JP)

(73) Assignee: Ohi Seisakusho Co., Ltd., Yokohama (JP)

( * ) Notice: Subject to any disclaimer, the term of this patent is extended or adjusted under 35 U.S.C. 154(b) by 68 days.

(21) Appl. No.: 09/749,552

(22) Filed: Dec. 28, 2000

(65) Prior Publication Data

US 2001/0005079 A1 Jun. 28, 2001

(30) Foreign Application Priority Data

Dec. 28, 1999 (JP) ..... 11-373609
Dec. 28, 1999 (JP) ..... 11-373610

(51) Int. Cl.[7] ..... E05C 3/06
(52) U.S. Cl. ..... 292/201; 292/216
(58) Field of Search ..... 292/216, 201, 292/DIG. 23; 49/280

(56) References Cited

U.S. PATENT DOCUMENTS 4,927,204 A * 5/1990 Asada ..... 292/216
6,003,910 A * 12/1999 Dupont ..... 292/201
6,332,634 B1 * 12/2001 Fukumoto ..... 292/201

FOREIGN PATENT DOCUMENTS

JP 5-27748 4/1993

* cited by examiner

*Primary Examiner*—Gary Estremsky
(74) *Attorney, Agent, or Firm*—Foley & Lardner

(57) ABSTRACT

An output mechanism includes a closing lever adapted to rotate from a neutral position in two opening and closing directions when a motor is allowed to rotate clockwise and counterclockwise and to rotate a latch from a half-latched position to a full-latched position when rotating in the closing direction and having an engagement portion at a free end portion thereof, and an opening lever having an engagement arm adapted to rotate from a waiting position to an open position by the engagement portion when the closing lever rotates from the neutral position thereof in the opening direction and to allow the engagement portion to move idly after having reached the open position and an opening portion adapted to release the engagement of a locking plate with the latch by virtue of the rotation of the engagement arm. The motor, the opening lever and the closing lever are fixed to and secured pivotally to a base plate secured to a lock main body, respectively.

9 Claims, 7 Drawing Sheets

AUTOMOTIVE LOCK OPENING AND CLOSING APPARATUS

BACKGROUND OF THE INVENTION

1. Field of the Invention

The present invention relates to an automotive lock opening and closing apparatus provided with a closing function for forcibly moving a lock device for an automotive open and close body from a half-latched position to a full-latched position by driving a motor and an opening function for releasing the engagement of the lock device with a striker.

The present application is based on Japanese Patent Applications No. Hei. 11-373609 and 373610, which are incorporated herein by reference.

2. Description of the Related Art

An automotive lock opening and closing apparatus as described above (for example, JP-B-5-27748) is known which comprises a lock main body having a latch for engaging with and disengaging from a striker and a locking plate for engaging with and disengaging from the latch and an output mechanism having a rotating member which can rotate from a neutral position in two directions, wherein the engagement of the latch with the locking plate is released when the rotating member is allowed to rotate in one direction from the neutral position and the latch is moved from a half-latched position to a full-latched position when the rotating member is allowed to rotate in the other direction.

In a conventional automotive lock opening and closing apparatus as described above, however, since the latch and the locking plate of the lock main body are connected to the rotating member of the output mechanism via the connecting member such as a rod or the like, respectively, there are caused problems that the connected constituent components get loosened, thereby making it difficult to obtain the positive operation of the apparatus and that the entire size of the apparatus is made large, thereby putting limitations on the mounting space.

Further, in the conventional automotive lock opening and closing apparatus as described above, in order to make common use of a motor as a motor for moving the latch on which a large magnitude of load is acting and as a motor for moving the locking plate which can be moved with a small magnitude of force, a high-output motor is used. Also, the connecting mechanism for connecting the rotating member with the locking plate or the opening mechanism is made rigid in construction so as to bear a large magnitude of load.

This results in the opening mechanism of excessive quality and the output mechanism which is large in size and heavy in weight and increases the production cost.

SUMMARY OF THE INVENTION

The present invention was made in view of the problems inherent in the conventional art, and an object thereof is to provide an automotive lock opening and closing apparatus which can be made simple in construction and small in size and which can obtain the positive operation thereof.

Another object of the present invention is to provide an automotive lock opening and closing apparatus which can make an opening mechanism, as well as an output mechanism small in size and light in weight.

According to the present invention, there is provided an automotive lock opening and closing apparatus comprising an output mechanism, the output mechanism comprising: a lock main body having a latch for engaging with a striker and a locking plate for engaging with the latch for preventing rotation of the latch; a motor rotating clockwise and counterclockwise, wherein an engagement of the latch with the locking plate is released when the motor is allowed to rotate clockwise and the latch is moved from a half-latched position to a full-latched position when the motor is allowed to rotate counterclockwise; an opening lever for releasing the engagement of the locking plate with the latch by being caused to engage with the locking plate when the motor is allowed to rotate clockwise; and a closing lever adapted to rotate the latch from the half-latched position to the full-latched position by being caused to engage with the latch when the motor is allowed to rotate counterclockwise, wherein the lock main body has secured thereto a base plate to which the motor is fixed and to which the opening lever and the closing lever are pivotally secured, respectively.

In the above an automotive lock opening and closing apparatus, the output mechanism may be pivotally secured to the base plate and further comprises a rotating member which can rotate from a neutral position in two opening and closing directions when the motor is allowed to rotate clockwise and counterclockwise, and wherein the rotating member and the opening lever and closing lever are linked with each other, respectively.

Preferably, the rotating member and the closing lever are disposed on one side of the base plate on the lock main. body, while the opening lever is disposed on the other side of the base plate, and wherein the opening lever and the closing lever-or the. rotating member are linked with each other via a pin penetrating through the base plate.

Further, according to the present invention, there is provided an automotive lock opening and closing apparatus comprising an output mechanism, the output mechanism comprising: a lock main body having a latch for engaging with a striker and a locking plate for engaging with the latch for preventing rotation of the latch; a motor rotating clockwise and counterclockwise, wherein an engagement of the latch with the locking plate is released when the motor is allowed to rotate clockwise and the latch is moved from a half-latched position to a full-latched position when the motor is allowed to rotate counterclockwise; a closing lever adapted to rotate from a neutral position in two opening and closing directions when the motor is allowed to rotate clockwise and counterclockwise and to rotate the latch from the half-latched position to the full-latched position when rotating in the closing direction and having an engagement portion at a free end portion thereof; and an opening lever having an engagement arm adapted to rotate from a waiting position to an open position by the engagement portion when the closing lever rotates from the neutral position thereof in the opening direction and to allow the engagement portion to move idly after having reached the open position and an opening portion adapted to release the engagement of the locking plate with the latch by virtue of the rotation of the engagement arm.

In the above automotive lock opening and closing mechanism a sliding contact edge may be provided at a distal end of the engagement arm of the opening lever for preventing the rotation of the opening lever for restoration toward the waiting position by being brought into contact with the engagement portion when the engagement portion moves idly.

Preferably, the sliding contact edge is formed so as to form an arc-like configuration arcing around a rotational center of the closing lever when the opening lever is located at the open position.

Features and advantages of the invention will become understood from the following detailed description of the preferred embodiments described in conjunction with the attached drawings.

BRIEF DESCRIPTION OF THE DRAWINGS

In the accompanying drawings:

FIG. 12 shows a plan view, taken in the same manner as done in. FIG. 9, of the same lock main body when a locking plate is located at an open position.

DETAILED DESCRIPTION OF THE PREFERRED EMBODIMENTS

Figure 1:
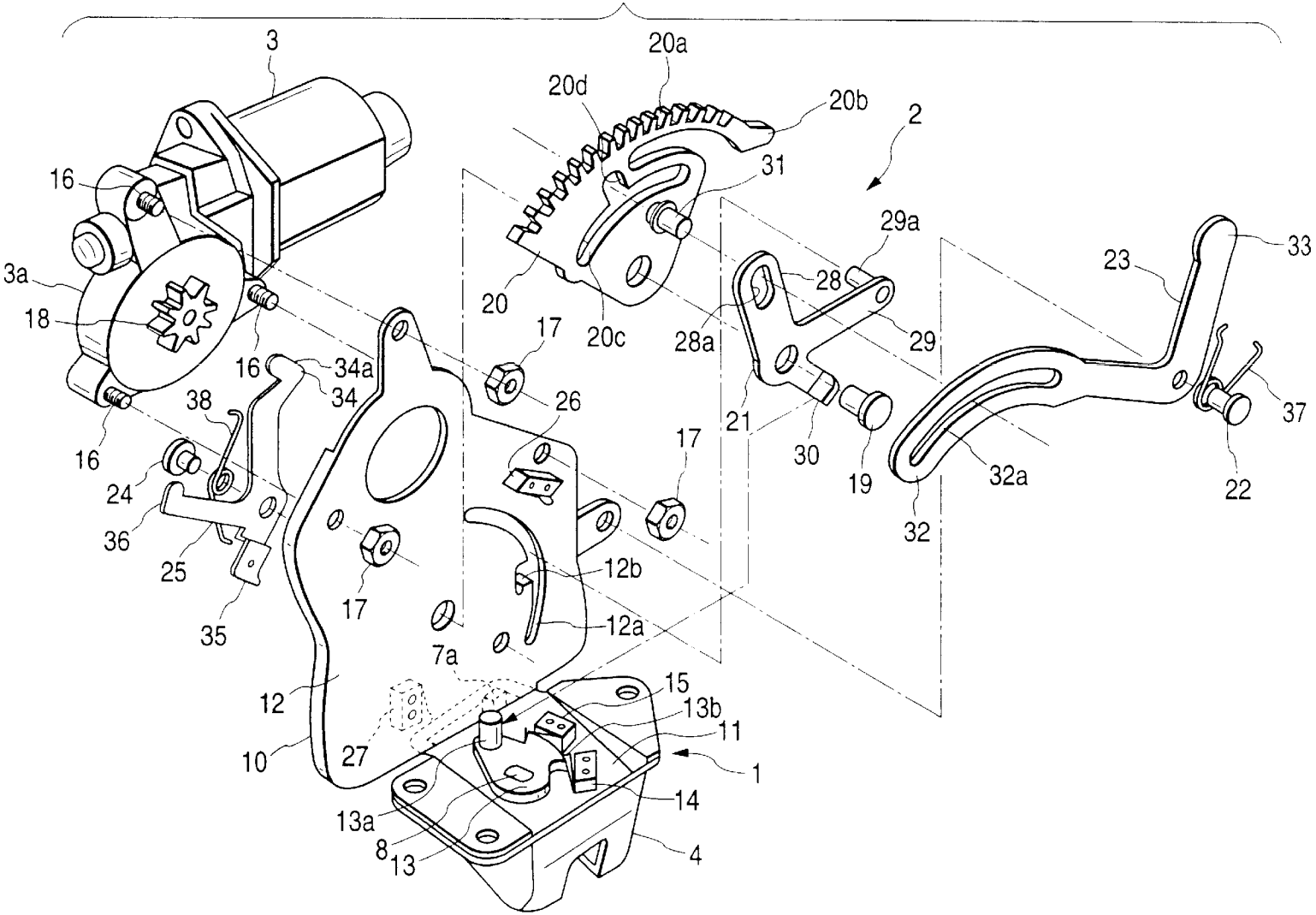
FIG. 1 shows an exploded perspective view of a lock main body and an output mechanism according to one embodiment of the invention.

Referring to the drawings, an embodiment of the invention will be described below.

In the drawings, reference numeral 1 denotes a lock main body which is fixed to a back door (not shown) pivotally secured to a rear part of the body of an automotive vehicle at an upper end thereof via laterally oriented hinge shafts (not shown) so that the door opens and closes vertically, and this lock main body is constructed so as to lock the back door in a closed state when it is brought into engagement with a striker 5 secured to the vehicle body side.

Reference numeral 2 denotes an output mechanism provided with a closure function to forcibly shift the lock main body 1 from a half-latched state to a full-latched state, an opening function to release the engagement of the lock main body 1 with the striker 5, and a canceling function to cancel the closure function.

Pivotally secured in the interior of a body 4 of the lock main body 1 via a vertically oriented latch shaft 8 and a locking plate shaft 9 are a latch 6 adapted to engage with and disengage from the striker 5 secured to the vehicle body side and a locking plate 7 adapted to engage with and disengage from ratchet portions 6*a*, 6*b* of the latch 6.

Figure 9:
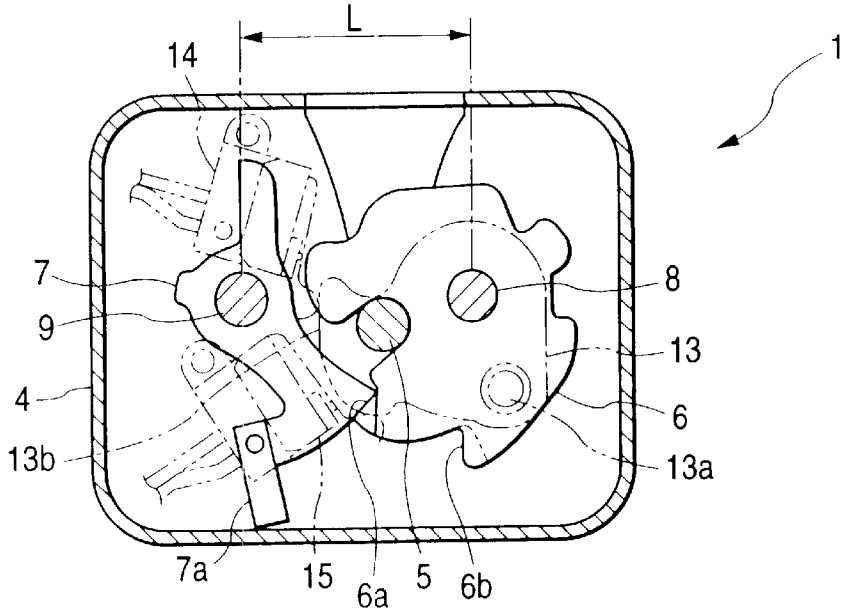
FIG. 9 shows a plan view, taken along the line IX—IX in FIG. 3, of the same lock main body which is in a full-latched state.
Figure 10:
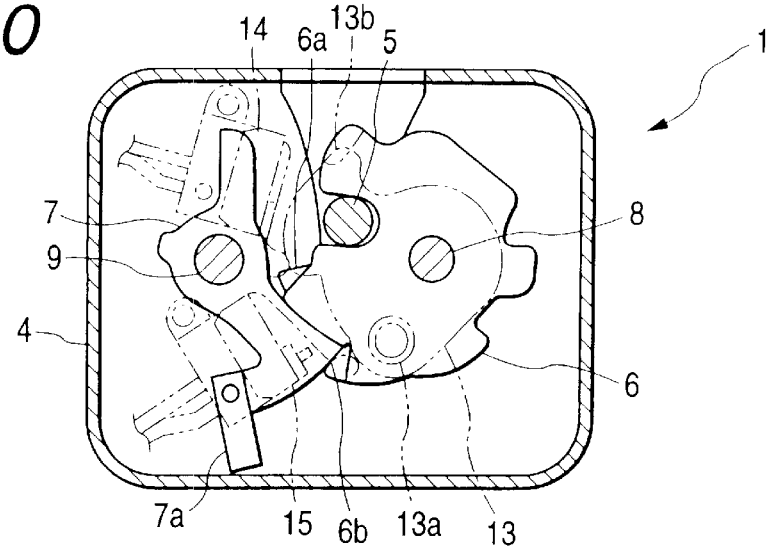
FIG. 10 shows a plan view, taken in the same manner as done in FIG. 9, of the same lock main body which is in a half-latched state.
Figure 11:
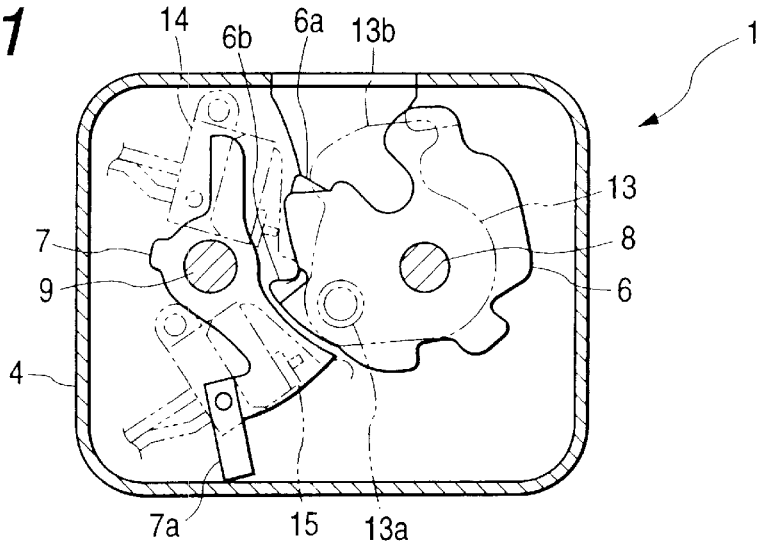
FIG. 11 shows a plan view, taken in the same manner as done in FIG. 9, of the same lock main body which is in an open state.

The latch 6 can move to a full-latched position, as shown in FIG. 9, where the latch 6 is in full engagement with the striker 5, a half-latched position, as shown in FIG. 10, where the latch 6 is in narrow engagement with the striker 5, and an open position, as shown in FIG. 11, where the latch 6 is out of engagement with the striker 5.

Figure 12:
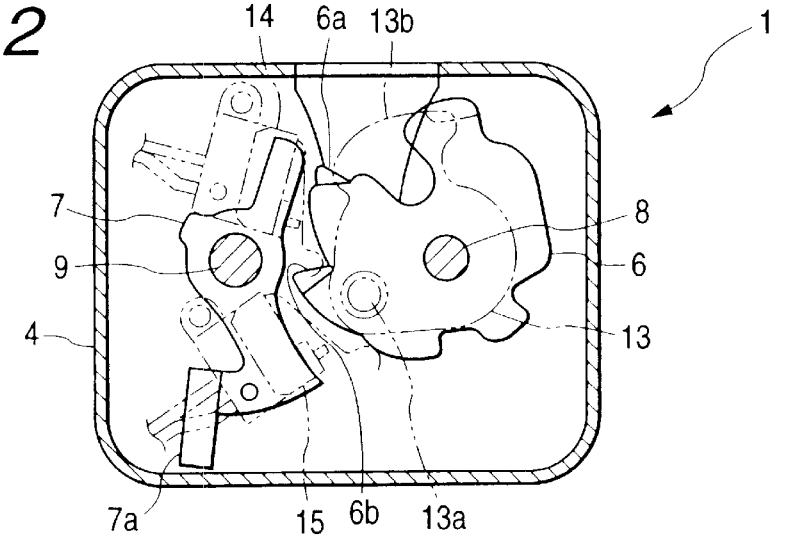

The locking plate 7 is biased in a counterclockwise direction with a spring (not shown) as shown in FIG. 9, and is constructed to prevent the rotation of the latch 6 in an opening direction by being caused to engage with the ratchet portion 6*a* when in the full-latched state and with the ratchet portion 6*b* when in the half-latched state. In addition, the locking plate 7 can move to the open position, as shown in FIG. 12, where the plate is out of engagement with the respective ratchet portions 6*a*, 6*b*.

A base plate 10 secured to the body 4 has a substantially horizontal cover portion 11 for covering an upper side of the body 4 and a base portion 12 erecting substantially vertically from a rear portion (a top farther side in FIG. 1) of the cover portion 11.

Disposed on the cover portion 11 are a cam lever 13 constituting a part of the latch 6 which is secured fastened to a latch shaft 8 so as to rotate together with the latch 6 and has an upwardly projecting engagement pin 13*a* at a free end portion thereof, a half-latch detection switch 14 for detecting the half-latched position of the latch 6 by detecting a cam portion 13*b* formed on an outer circumference of the cam lever 13, and a full-latch detection switch 15 for detecting the full-latched position of the latch 6 in the same manner.

A motor 3 is fixed to an upper portion on a reverse side of the base portion 12 with a plurality of bolts 16 and nuts 17 and has a gear 18 which can rotate clockwise and counterclockwise via a speed reduction mechanism (not shown) built in a motor case 3*a*.

The output mechanism 2 is pivotally secured to a front side of the base portion 12 via a longitudinally oriented shaft 19 and has a sector gear 20 constituting a rotating member having teeth 20*a* meshing with the gear 18, a closing lever 21 pivotally secured to the front side of the base portion 12 with the same shaft 19 as used for the pivotal securement of the sector gear 20, a canceling lever 23 pivotally secured to the front side of the base. portion 12 via a shaft 22, and an opening lever 25 pivotally secured to the reverse side of the base portion 12 via a shaft 24.

Figure 3:
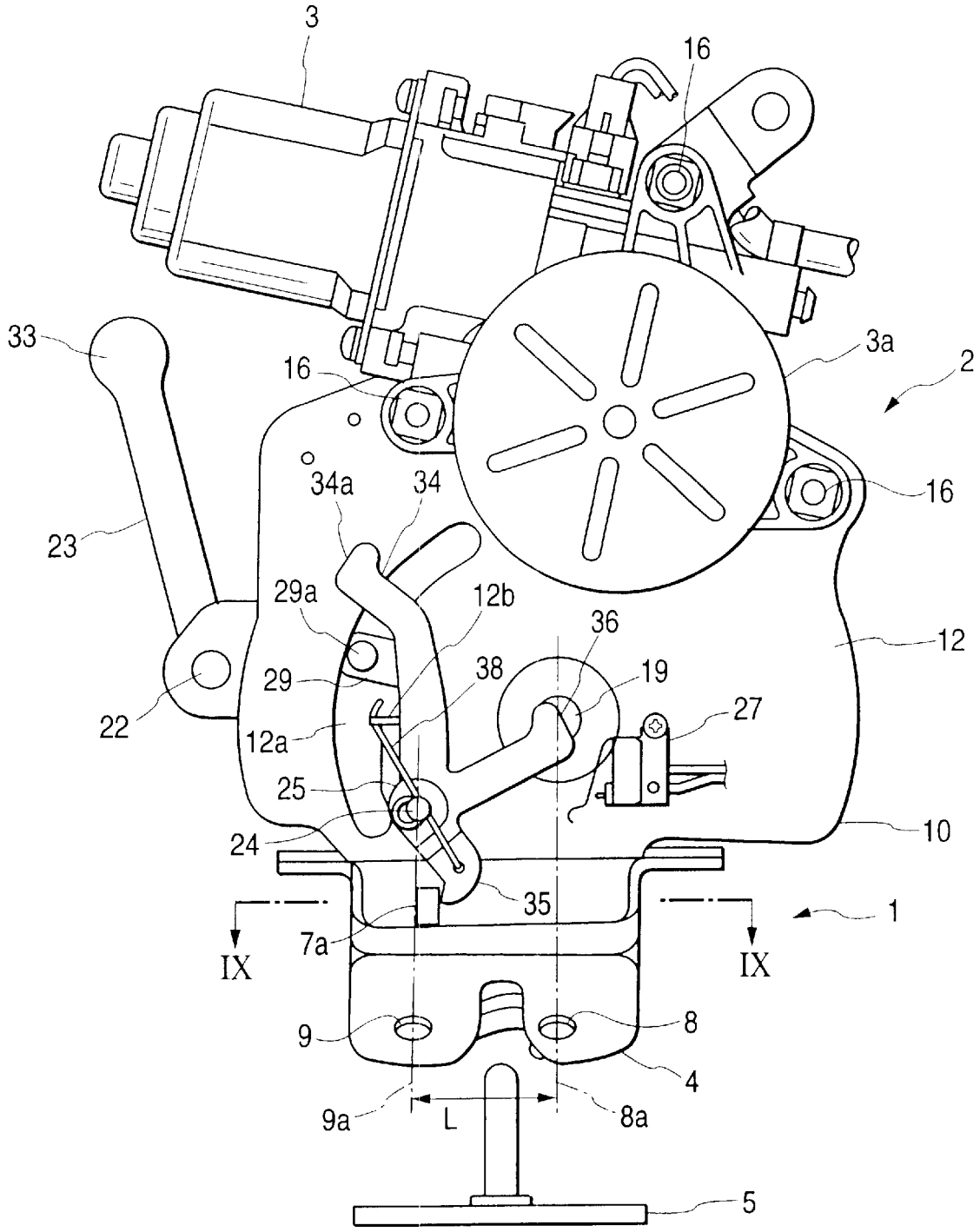
FIG. 3 shows a rear view of the same lock main body and output mechanism.

The shaft 19 is, as shown in FIG. 3, disposed on an axis 8a of the latch shaft 8 when viewed from the front, and the shaft 24 is disposed on an axis 9*a* of a locking plate shaft 9, whereby a lateral shaft interval distance between the shaft 19 and the shaft 24 is set substantially equal to a shaft interval distance L between the latch shaft 8 and the locking plate shaft 9.

Note that since the closing lever 21 needs to move the latch 6 from the half-latched position to the full-latched position with a large magnitude of force, the closing lever 21 is formed of a thick material so as to bear such a large magnitude of force, whereas since the opening lever 25 is designed to move the locking plate 7 which requires no such large magnitude of force for movement, the opening lever 25 is formed of a material which is thinner than the closing lever 21.

Formed in the base portion 12 are an elongate hole 12*a* which is vertically oriented and arcs around the shaft 19 and a stopper 12*b* cut out rearward of the base portion 12 from substantially the center of the elongate hole 12*a*. Moreover, provided on the reverse side and the front side of the base portion 12, respectively, are a neutral detection switch 26 for detecting a neutral position, which will be described later, of the sector gear 20 and an opening detection switch 27 .for detecting an open position, which will be described later, of the opening lever 25.

The motor 3 is constructed to be controlled such that a it rotates clockwise through manipulation of a handle switch (not shown) provided on an outer panel of the back door and actuation of the full-latch detection switch 15, that it rotates counterclockwise through actuation of the half-latch detection switch 14 and that it stops through actuation of the neutral detection switch 26.

Figure 2:
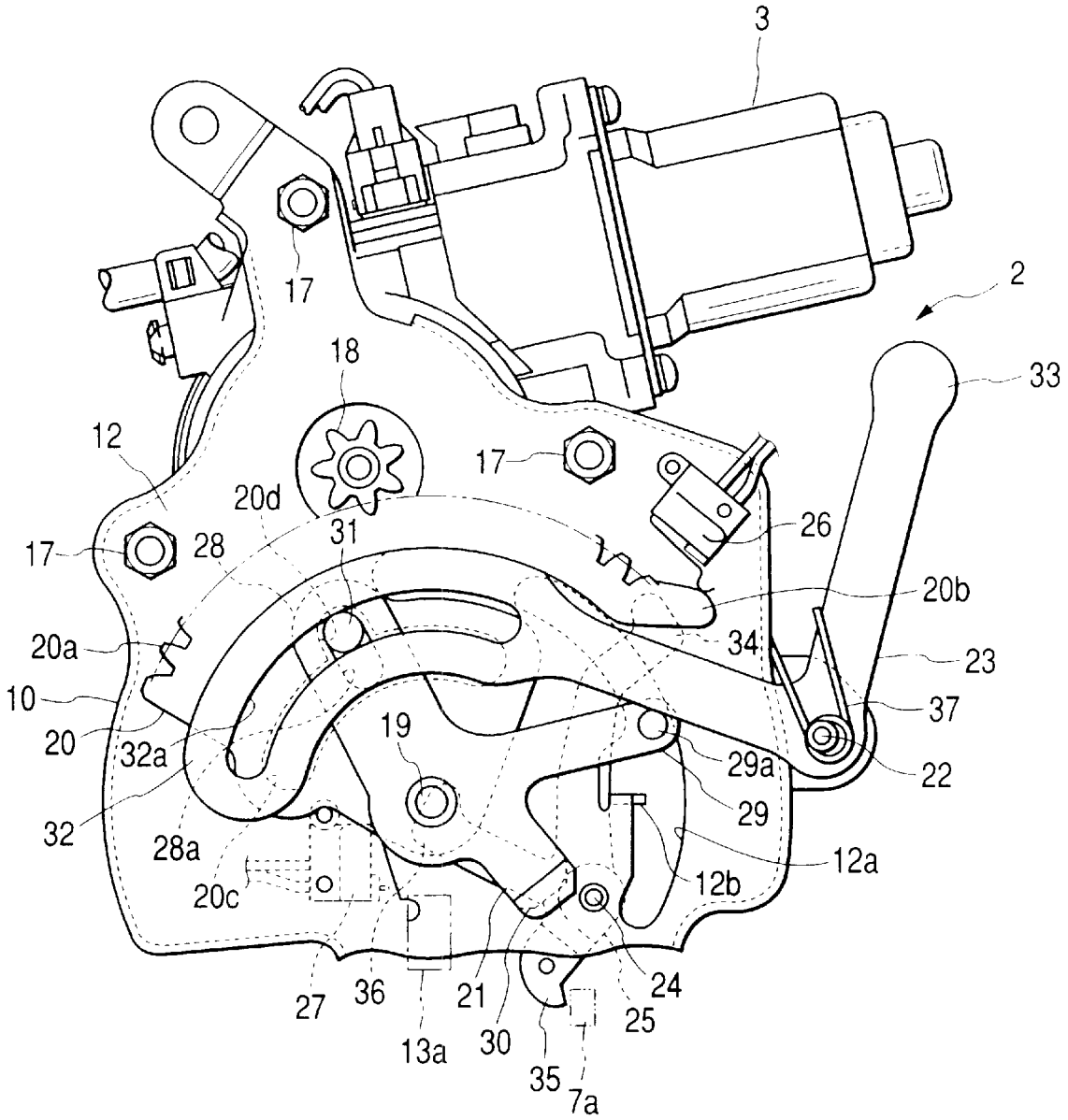
FIG. 2 shows a front view of the same output mechanism.
Figure 4:
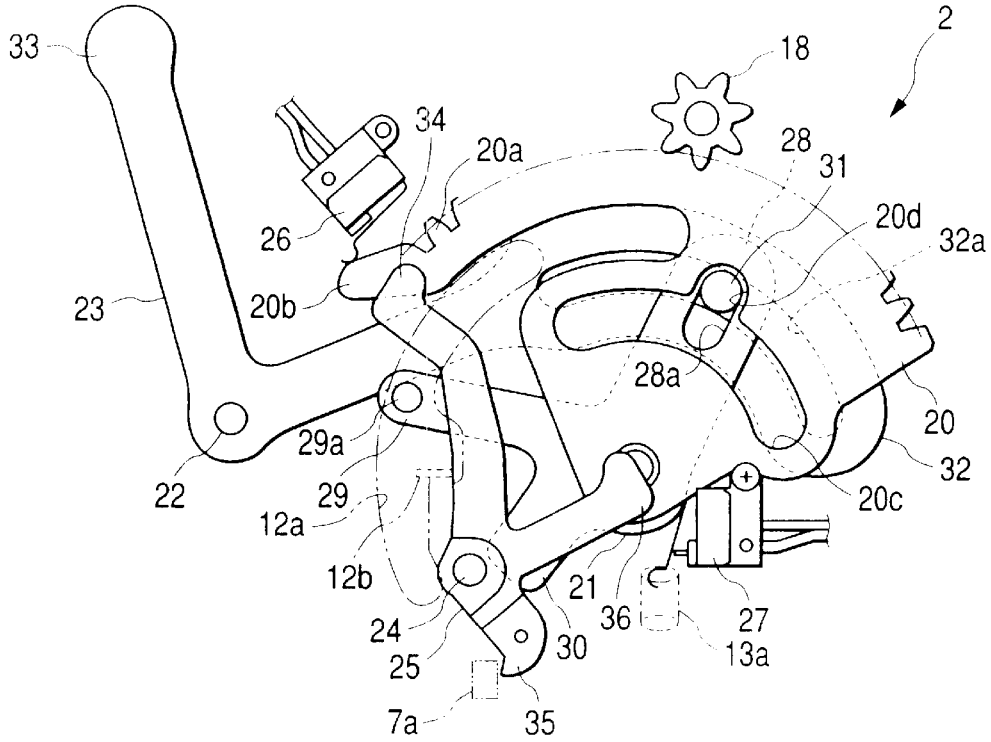
FIG. 4 shows an explanatory view explaining the operation of the same output mechanism when a closing lever is located at a neutral position, as viewed from the rear.

The sector gear 20 has a projecting portion 20*b* provided at a distal end of the toothed portion 20*a*, a laterally oriented elongate hole 20*c* which arcs around the shaft 19 as the center thereof and an engagement hole 20*d* extending from substantially the longitudinal center of the elongate hole 20*c* in a direction which goes away from the center. As shown in FIGS. 2 and 4, the sector gear 20 normally stops at the neutral position where the neutral detection switch 26 is brought into abutment with the projecting portion 20*b* for actuation thereof, and is constructed so as to rotate from this neutral position in the opening direction (the counterclockwise direction in FIG. 2, and in the clockwise direction in FIG. 4) and in the closing direction (the clockwise direction in FIG. 2, and in the counterclockwise direction in FIG. 4) when the motor 3 rotates clockwise and counterclockwise, respectively.

The closing lever 21 has an arm portion 28 extending upwardly and having formed therein a switching hole 28*a* which can overlap the part of the elongate hole 20*c* and the engagement hole 20*d* of the sector gear 20, an opening arm portion 29 extending sideward so as to overlap the opening lever 25 with the base portion 12 being held therebetween and having a pin 29*a* provided at a distal end thereof so as to project therefrom rearward through the elongate hole 12*a* in the base portion 12 and a closing portion 30 extending diagonally downwardly toward the body 4. The closing lever 21 is normally constructed so as to rotate from the neutral position in the two directions together with the sector gear 20.

The closing portion 30 is brought into engagement with the engagement pin 13*a* when the closing lever 21 rotates from the neutral position in the closing direction to thereby rotate the cam lever 13 so as to move the latch 6 from the half-latched position to the full-latched portion.

A collared pin-like switching member 31 is provided between the sector gear 20 and the arm portion 28 of the closing 12) lever 21 which is slidably fitted in the elongate hole 20*c* and the engagement hole 20*d*, and the switching hole 28*a*.

Figure 8:
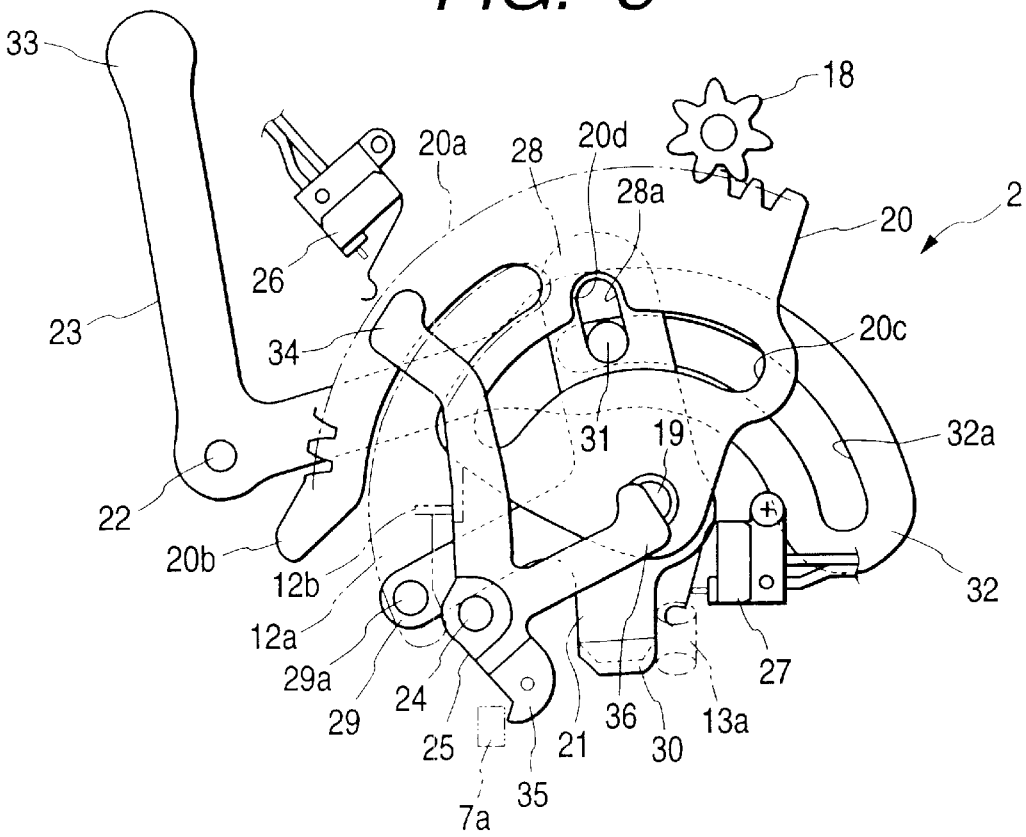
FIG. 8 shows an explanatory view explaining the operation of the same output mechanism when a canceling lever is located at a cancel position, as viewed from the rear.

The switching member 31 can engage with and disengage from the engagement hole 20*d* in the sector gear 20, and as shown in FIGS. 2 and 4, when the switching member 31 is located at a connecting position where it is positioned in an upper portion of the switching hole 28*a* and engages with the engagement hole 20*d*, the switching member 31 connects the sector gear 20 with the closing lever 21 so that the closing lever 21 rotates together with the sector gear 20 as the latter rotates. In addition, as shown in FIG. 8, when the switching member 31 is located at a cancel position where the switching member 31 is positioned in a lower portion of the switching hole 28*a* and disengages from the engagement hole 20*d* to move into the elongate hole 20*c*, the switching member 31 is allowed to slide from the center in either of the leftward and rightward directions along the elongate hole 20*c* so as to disconnect the connection between the sector gear 20 and the closing lever 21 so that the sector gear 20 and the closing lever 21 are allowed to rotate independently from each other.

The canceling lever 23 has a curved arm portion 32 arcing around the shaft 19 as the center thereof and having formed therein a guide hole 32*a* and overlapping the elongate hole 20*c* and the engagement hole 20*d*, and the switching hole 28*a* so as to allow the switching member 31 to slidably fit therein and a manipulating portion 33 extending upwardly. The canceling lever 23 can move to a connecting position where the switching member 31 is held at the connecting position and a canceling position where the switching member 31 is held at the canceling position and is normally held at the connecting position with a spring 37.

The manipulating portion 33 is provided at a position where the portion can be manipulated from the outside by partially removing the trim on an inner panel side of the back door.

The opening lever 25 has an engagement arm 34 extending substantially upwardly so as to intersect with the guide groove 12*a* in the base portion 12 and allowed to engage with the pin 29*a* when the closing lever 21 rotates in the opening direction, an opening portion 35 extending downwardly toward the body 4 and adapted to be brought into abutment with a projecting portion 7*a* of the locking plate 7 and a detection arm portion 36 extending rightward in FIG. 3 so as to be allowed to contact the opening detection switch 27. The opening lever 25 is allowed to rotate from a waiting position where the engagement arm 34 is in engagement with the stopper 12*b* in the opening direction (the counterclockwise direction in FIG. 2, and the clockwise direction in FIG. 3) which rotates the locking plate 7 in the opening direction, and is normally biased toward the waiting position with a spring 38.

The opening portion 35 is brought into abutment with the projecting portion 7*a* of the locking plate 7 when the opening lever 25 rotates in the opening direction to thereby move the locking plate 7 to the open position.

Figure 6:
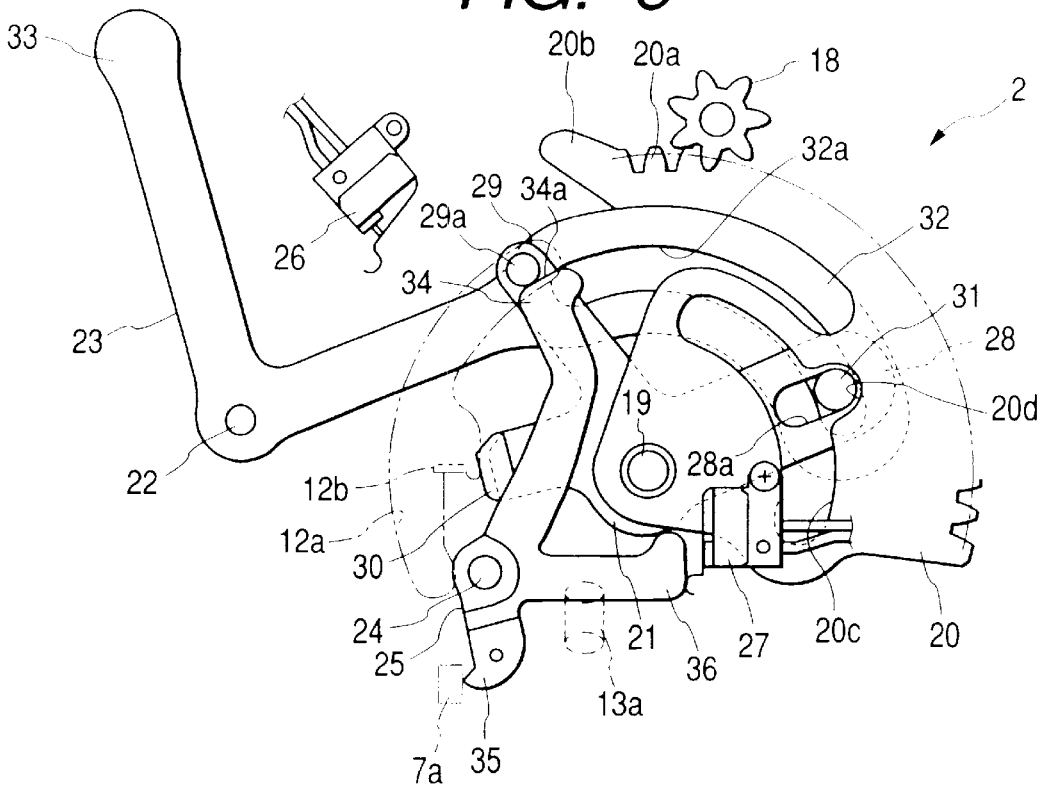
FIG. 6 shows an explanatory view explaining the operation of the same output mechanism when a closing lever is located at an open position as viewed from the rear.

When the closing lever 21 rotates from the neutral position in the opening direction, the pin 29*a* is brought into sliding contact with the engagement arm 34 to thereby rotate the opening lever 25 from the waiting position in the opening direction, and as shown in FIG. 6, after the opening lever 25 has moved to the open position, the engagement arm 34 deviates from the traveling locus of the pin 29*a*, whereby the pin 29*a* comes to slide along an outer edge (sliding contact edge) 34*a* of the engagement arm 34, thereby allowing the closing lever 21 to idly move in the opening direction with the opening lever 25 being held at the open position.

Note that the outer edge (sliding contact edge) 34*a* of the engagement arm 34 of the opening lever 25 is constructed so as to form an arc-like shape arcing around the shaft 19 as the center thereof when the opening lever 25 moves to the open position. This construction allows the opening lever to be held positively at the open position while the closing lever 21 idly rotates.

Therefore, immediately the motor 3 stops through the detection by the opening detection switch 27, even if the closing lever 12 is caused to pass through the open position due to inertia forces acting thereon variously, since no movement occurring after the closing lever has passed through relative to the opening lever 25 is transmitted to the opening lever 25, the deformation of and damages to the opening lever 25 can be prevented.

Next, referring to FIGS. 4 to 12, the respective functions of the above embodiment will be described below.

(Opening Function)

As shown in FIG. 4, in the output mechanism 2, the sector gear 20 and closing lever 21 are at the neutral position, and the switching member 31 is held at the connecting position, whereby the sector gear 20 and the closing lever 21 are connected to each other. As shown in FIG. 9, in the lock main body 1, the latch 6 is at the full-latched portion and the locking plate 7 is in engagement with the ratchet portion 6*a* of the locking plate 7.

Figure 5:
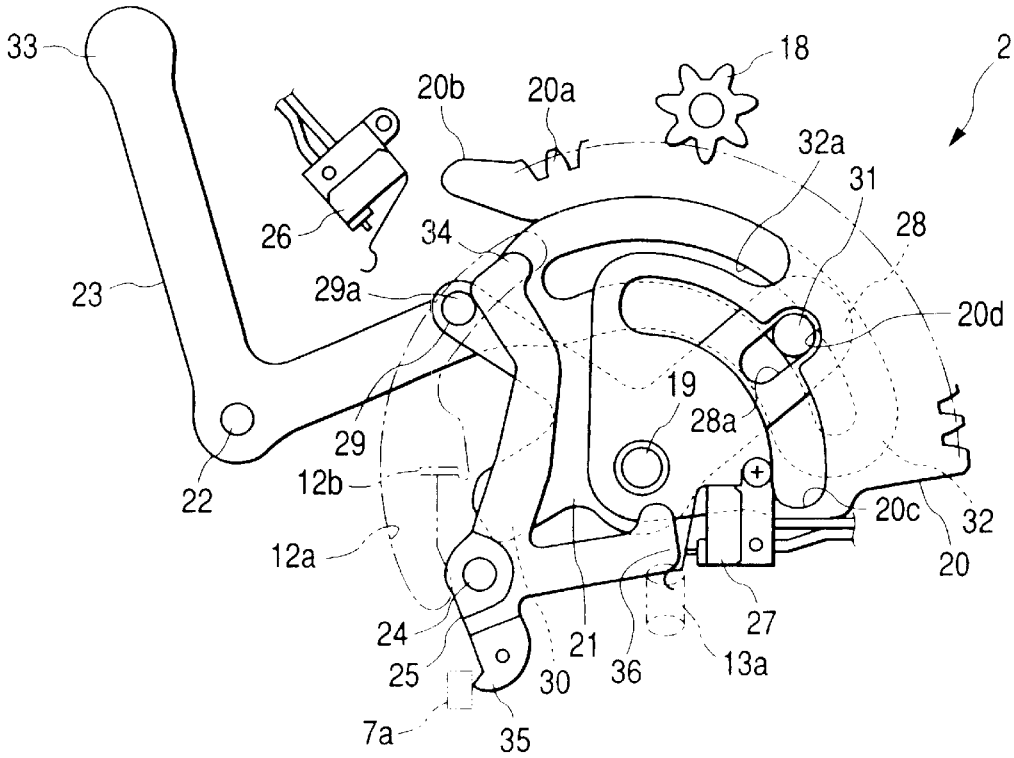
FIG. 5 shows an explanatory view explaining the operation of the same output mechanism when the closing lever is performing an opening operation, as viewed from the rear.

In this state, when the handle switch on the back door is actuated, the motor 3 rotates clockwise, and the sector gear 20 and the closing lever 21 rotate from the neutral position in the opening direction, whereby, as shown in FIG. 5, the switching member 31 moves in the rightward direction within the guide hole 32*a*, and the pin 29*a* pushes the engagement arm 34 of the opening lever 25 to move to the open position shown in FIG. 6 after passing through a state shown in FIG. 5.

When the opening lever 25 moves to the open position, the engagement arm 34 deviates from the traveling locus of the pin 29*a*, and the opening lever 25 rotates no further and is then held at the open position, with the opening portion 35 being in engagement with the projecting portion 7*a* on the locking plate 7 to thereby move the locking plate 7 to the open position, thereby making it possible to open the back door.

When the opening detection switch 27 detects the detection arm portion 36, the motor 3 is then controlled to rotate counterclockwise, and the sector gear 21 and the closing lever 21 are restored from the open position to the neutral position, whereby, as shown in FIG. 4, the neutral detection switch 26 comes to detect the projecting portion 20*b* and the feeding to the motor 3 is stopped, this allowing the opening lever 25 to be restored to the waiting position by virtue of the biasing force of the spring 38.

(Closing Function)

When the back door is in the open state, the lock main body 1 and the output mechanism 2 remain in the states shown in FIGS. 2 and 4, respectively.

If the back door is closed from this state, the latch 6 engages with the striker 5 and moves from the open position to the half-latched position shown in FIG. 10.

Figure 7:
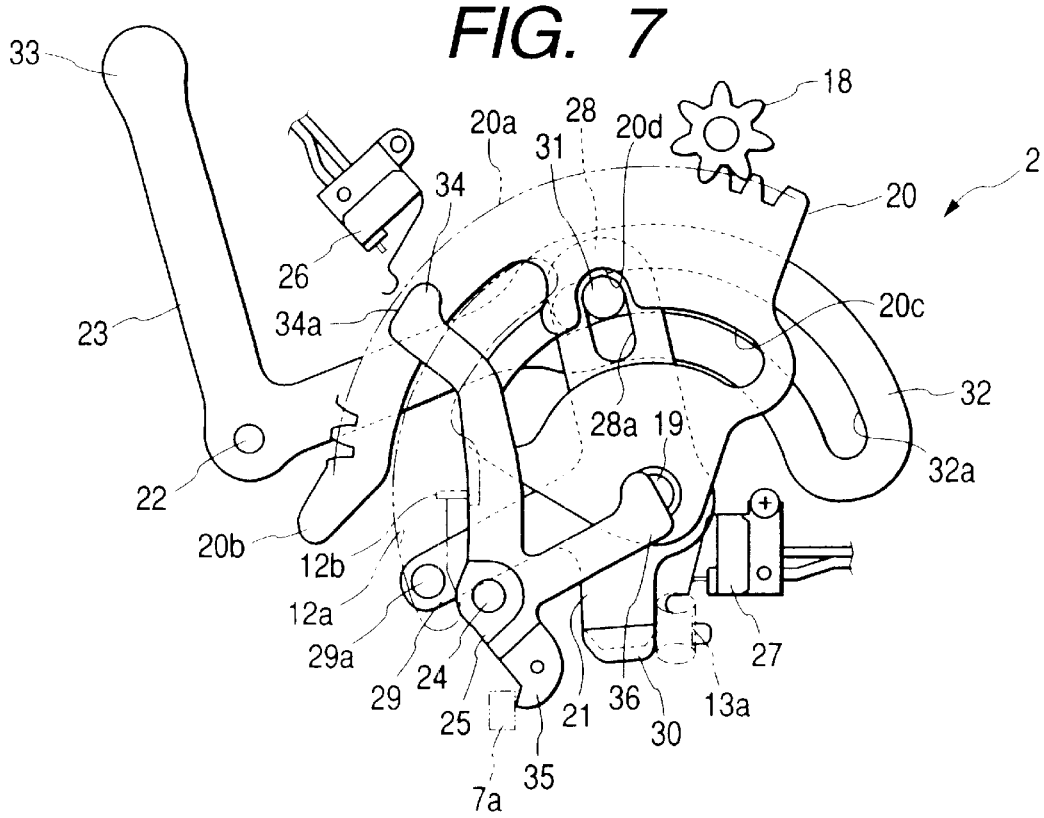
FIG. 7 shows an explanatory view explaining the operation of the same output mechanism when a closing lever is located at a close position, as viewed from the rear.

When the half-latch detection switch 14 detects the arrival of the latch 6 at the half-latched position via the cam lever 13, the motor 3 is controlled to rotate counterclockwise, and as shown in FIG. 7, the sector gear 20 and the closing lever 21 rotate in the closing direction and the switching member 35 moves in the leftward direction within the guide hole 32*a*.

When the closing lever 21 moves in the closing direction, the closing portion 30 is brought into engagement with the engagement pin 13*a* of the cam lever 13 to forcibly move the latch 6 from the half-latched position to the full-latched position, whereby the back door is pulled in a fully closed state from a half-closed state.

When the full-latch detection switch 15 detects that the latch 6 is in the full-latched position via the cam portion 13*a* of the cam lever 13, the motor 3 is controlled to rotate clockwise, and the sector gear 20 and the closing lever 21 are restored to the neutral position.

(Canceling Function)

In the event that the sector gear 20 stops at the close position, as shown in FIG. 8, because, for example, the motor 3 stops the rotation thereof due to the failure of the motor itself or a control circuit while the sector gear 20 and the closing lever 21 are in the course of closing operation, the closing portion 30 is brought into engagement with the engagement pin 13*a* of the cam lever 13 to thereby prevent the movement of the latch 6 in the opening direction, thereafter causing a risk that the back door fails to open. In a case where something like this happens, the opening operation of the back door can be restored.

Namely, when the canceling lever 23 moves to the cancel position, the switching member 31 moves to the cancel position, whereby the connection between the sector gear 20 and the closing lever 21 is disconnected. In this state, when the closing lever 21 is restored to the neutral position, the movement of the latch 6 to the open position is made possible. Thereafter, the locking plate 7 is caused to move to the open position by manipulating an operating means (not shown) separately disposed at a suitable position on an automotive vehicle, whereby the back door can be opened.

In addition, when the closing lever 21 rests at the open position, in the event that the motor stops the rotation thereof due to the same reason as described above, the locking plate 7 is retained at the open position via the opening lever 25, this leading to a risk that the back door fails to close. Also in a case where this happens, the retention of the locking plate 7 can be released by allowing the closing lever 21 to be restored to the neutral position with the canceling lever 23 being caused to move to the cancel position, whereby the back door can be closed.

Note that the invention is not limited to the embodiment described heretofore but may be modified in various ways. For example, while the sector gear 20 and the closing lever are provided separately in the above embodiment, they may be integrated into a single body with the canceling function being omitted. In addition, with the cam lever 13 being deleted and the closing portion 30 being caused to engage directly with the latch, the latch 6 may be constructed so as to rotate from the half-latched position to the full-lathed position.

According to the invention, the following advantages can be provided.

According to a first aspect of the invention, since both the motor and the output mechanism are mounted on the base plate of the lock main body so that the opening lever and the closing lever of the output mechanism engage directly with the locking plate and the latch, there is provided no connecting member for connecting the lock main body with the output mechanism, whereby the number of components can be reduced, thereby making it possible not only to make the construction and size of the apparatus simple and small, respectively, but also to reduce the effect of a looseness that would happen between the connected components, the positive operation of the apparatus being thus obtained.

According to a second aspect of the invention, a force can effectively be transmitted from the rotating member to the latch and the locking plate via the closing lever and the opening lever, thereby making it possible to obtain the positive operation of the apparatus.

According to a third aspect of the invention, since the closing lever and the opening lever can be disposed so as to overlap each other with the base plate being held therebetween, the miniaturization of the output mechanism can be attained.

According to a fourth aspect of the invention, since there is eliminated any risk of the movement of the closing lever directed by virtue of the driving force of the strong motor in the opening direction being transmitted to both the opening lever and the locking plate once the opening lever has reached the open position, the deformation of and/or damage to the opening lever can be prevented. Consequently, the constituent components on the opening mechanism can be light in weight, thin in thickness and small in size, and hence the output mechanism can be small in size and light in weight, this leading to a reduction in production cost.

According to a fifth aspect of the invention, when the closing lever moves idly, the opening lever can positively be retained at the open position, whereby the positive operation of the apparatus can be obtained.

According to a sixth aspect of the invention, when the closing lever moves idly, the opening lever can positively be retained at the open position so that the opening lever is prevented from being easily dislocated from the open position to thereby cause a malfunction.

What is claimed is:

1. An automotive lock opening and closing apparatus comprising an output mechanism, said output mechanism comprising:

a lock main body having a latch for engaging with a striker and a locking plate for engaging with said latch for preventing rotation of said latch;

a motor rotating clockwise and counterclockwise, wherein an engagement of said latch with said locking plate is released when said motor is allowed to rotate clockwise and said latch is moved from a half-latched position to a full-latched position when said motor is allowed to rotate counterclockwise;

an opening lever for releasing the engagement of said locking plate with said latch by being caused to engage with said locking plate when said motor is allowed to rotate clockwise; and a closing lever adapted to rotate said latch from said half-latched position to said full-latched position by being caused to engage with said latch when said motor is allowed to rotate counterclockwise, wherein said lock main body has secured thereto a base plate to which said motor is fixed and to which said opening lever and said closing lever are pivotally secured, respectively, and wherein said opening lever is disposed on a first side of said base plate and said closing lever is disposed on a second and opposite side of said base plate.

2. An automotive lock opening and closing apparatus according to claim 1, further comprising a rotating member which is pivotally supported on the base plate, which is in drive connection with the motor and which can rotate from a neutral position in opening and closing directions when said motor is allowed to rotate clockwise and counterclockwise, and wherein said rotating member and said opening lever and closing lever are linked with each other, respectively.

3. An automotive lock opening and closing apparatus according to claim 2, wherein said rotating member and said closing lever are disposed on one side of said base plate on said lock main body, while said opening lever is disposed on the other side of said base plate, and wherein said opening lever and said closing lever or said rotating member are linked with each other via a pin penetrating through said base plate.

4. An automotive lock opening and closing apparatus comprising an output mechanism, said output mechanism comprising:

a lock main body having a latch for engaging with a striker and a locking plate for engaging with said latch for preventing rotation of said latch;

a motor rotating clockwise and counterclockwise, wherein an engagement of said latch with said locking plate is released when said motor is allowed to rotate clockwise and said latch is moved from a half-latched position to a full-latched position when said motor is allowed to rotate counterclockwise;

a closing lever disposed on a first side of a base plate and adapted to rotate from a neutral position in opening and closing directions when said motor is allowed to rotate clockwise and counterclockwise and to rotate said latch from said half-latched position to said full-latched position when rotating in said closing direction and having an engagement portion at a free end portion thereof; and an opening lever disposed on a second side of the base plate and having an engagement arm adapted to be engageable with said engagement portion and to rotate from a waiting position to an open position when said closing lever rotates from said neutral position thereof in said opening direction and to allow said engagement portion to move idly after having reached said open position and an opening portion adapted to release the engagement of said locking plate with said latch by virtue of the rotation of said engagement arm.

5. An automotive lock opening and closing mechanism according to claim 4, wherein a sliding contact edge is provided at a distal end of said engagement arm of said opening lever for preventing the rotation of said opening lever for restoration toward said waiting position by being brought into contact with said engagement portion when said engagement portion moves idly.

6. An automotive lock opening and closing mechanism according to claim 5, wherein said sliding contact edge is formed so as to form an arc-like configuration arcing around a rotational center of said closing lever when said opening lever is located at said open position.

7. An automotive lock opening and closing apparatus according to claim 4, further comprising a canceling lever which is operatively connected with the closing lever and a rotating member which is pivotally supported on the base plate and which is in drive connection with the motor.

8. An automotive lock opening and closing apparatus according to claim 4, wherein said canceling lever has a manipulating portion that can be externally manipulated.

9. An automotive lock opening and closing apparatus according to claim 4, wherein said rotating member includes a sector gear which is in meshing engagement with a gear of the motor.

* * * * *